United States Patent [19]

Beske et al.

[11] Patent Number: 4,999,950

[45] Date of Patent: Mar. 19, 1991

[54] INWARDLY SWINGING HINGED DOOR ASSEMBLY

[75] Inventors: Scott R. Beske, Stillwater, Minn.; Harold H. Evans, Hudson, Wis.

[73] Assignee: Andersen Corporation, Bayport, Minn.

[21] Appl. No.: 430,061

[22] Filed: Oct. 30, 1989

Related U.S. Application Data

[63] Continuation of Ser. No. 166,621, Mar. 11, 1988, abandoned.

[51] Int. Cl.[5] ..... E05C 9/00

[52] U.S. Cl. ..... 49/395; 49/471; 49/476; 49/475

[58] Field of Search ..... 49/471, 475, 476, 477, 49/485, 489, 498, 395

[56] References Cited

U.S. PATENT DOCUMENTS

| | | | |
|---|---|---|---|
| 2,101,465 | 12/1937 | Beers | 49/485 |
| 4,548,432 | 10/1985 | Bengtsson | 292/8 |
| 4,716,683 | 1/1988 | Minter | 49/489 |

FOREIGN PATENT DOCUMENTS

| | | | |
|---|---|---|---|
| 0257896 | 10/1967 | Austria | 49/504 |
| 1683737 | 2/1971 | Fed. Rep. of Germany | 49/471 |
| 0186141 | 11/1936 | Switzerland | 49/476 |
| 0192317 | 3/1938 | Switzerland | 49/476 |

OTHER PUBLICATIONS

Andersen Drawing No. PSC-10186.

Selection Guide for Arch. Aluminum Windows, AAMA 1980.

*Primary Examiner*—Kenneth J. Dorner

*Assistant Examiner*—Gerald A. Anderson

*Attorney, Agent, or Firm*—Merchant, Gould, Smith, Edell, Welter & Schmidt

[57] ABSTRACT

An inwardly swinging door assembly includes a door member (10*a*) hingedly mounted to a frame (11). A multi-point lock (29) engages the frame (11) at more than one point. Weatherstripping (36) is cooperatively connected to the edged surfaces 24 through 27. A pressure equalization member (42) is cooperatively connected to the frame for engaging the weatherstrip (36) connected to the bottom edged surface (27).

15 Claims, 4 Drawing Sheets

FIG. 1
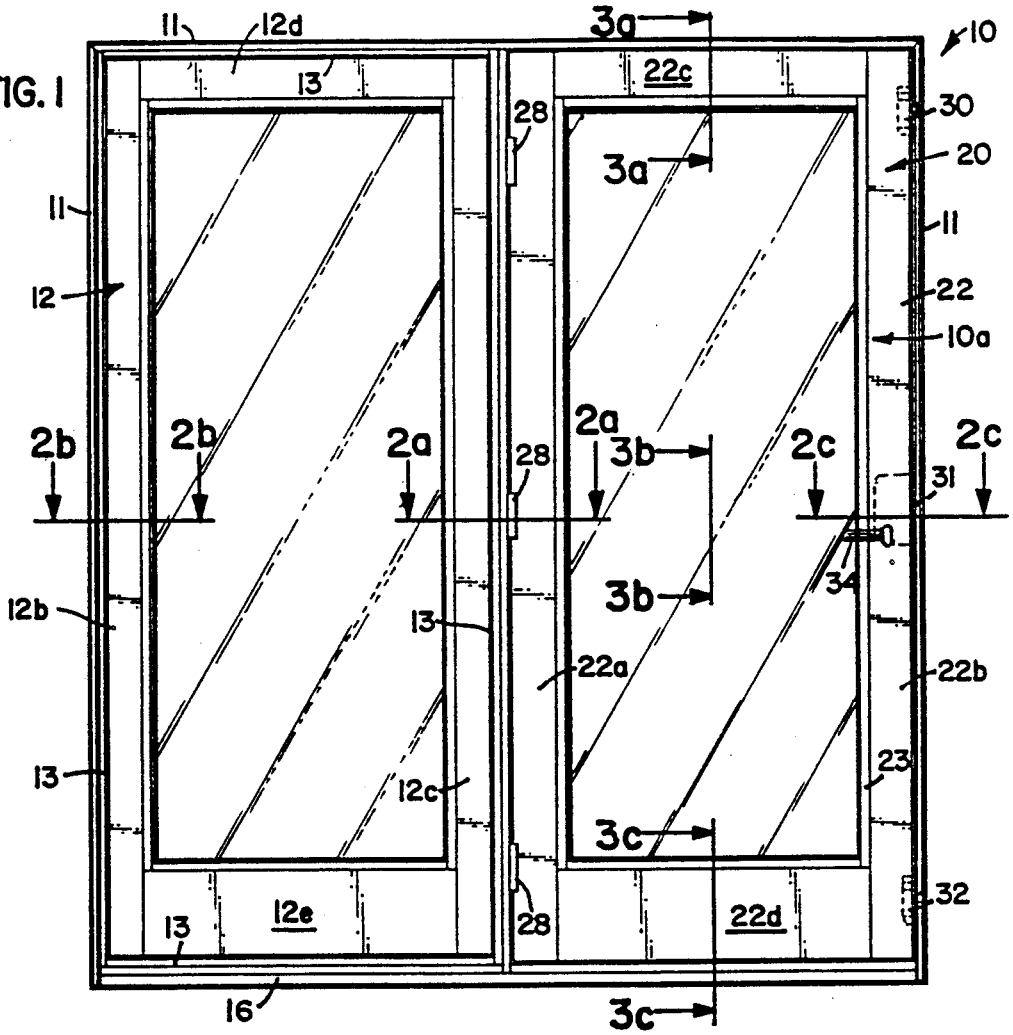
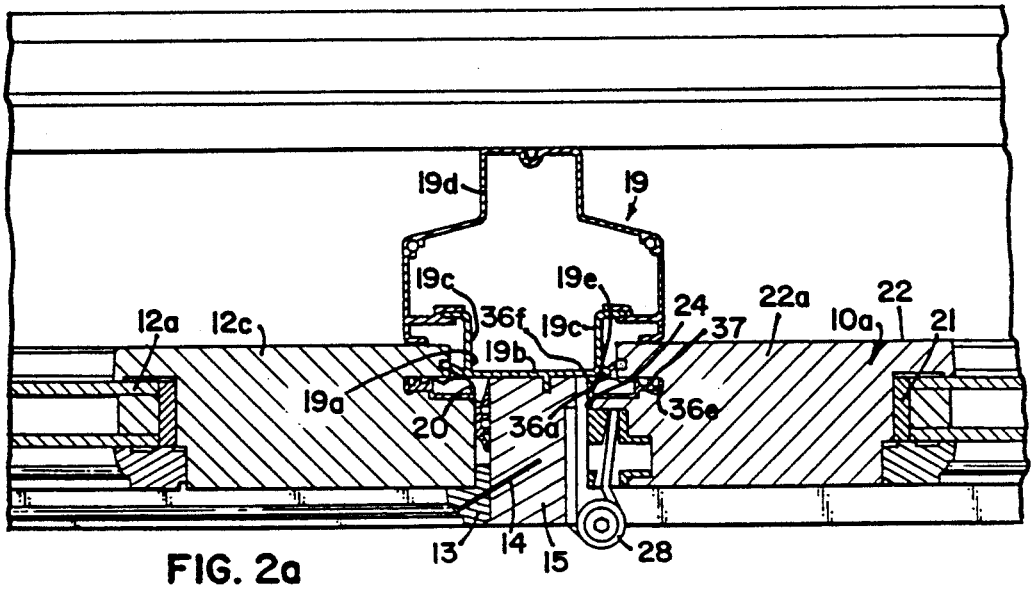
FIG. 2a

FIG. 3c
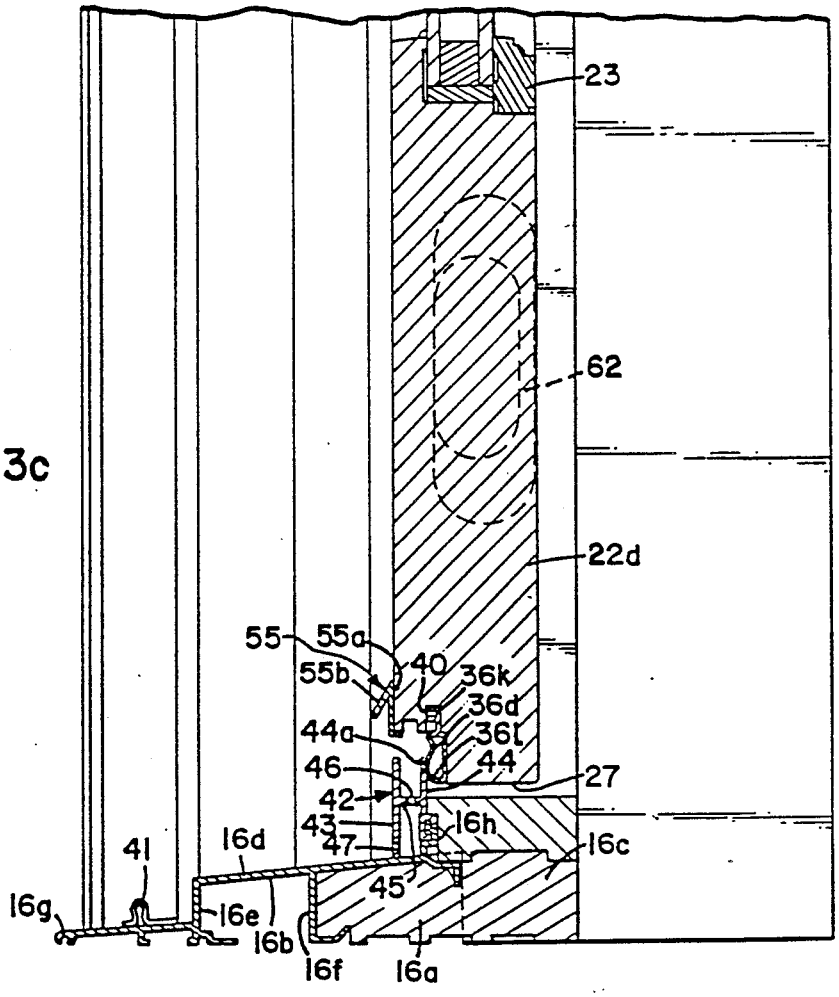
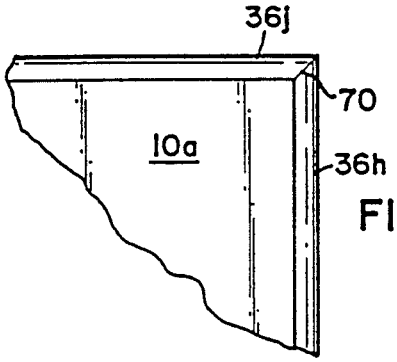
FIG. 4

INWARDLY SWINGING HINGED DOOR ASSEMBLY

This is a continuation of application Ser. No. 166,621, filed Mar. 11, 1988, now abandoned.

BACKGROUND OF THE INVENTION

This invention relates generally to an inwardly swinging door and more specifically to an inwardly swinging door that is constructed using a multi-point lock, weatherstripping in one plane and a pressure equalization member to provide for an improved weatherproof door.

DESCRIPTION OF THE PRIOR ART

Most doors utilize a single point lock. When a single point lock is utilized, the door is cooperatively connected to the frame of the door only by means of the hinges and the single point lock. The hinges are typically multi-point and connect the door to the frame at the top, middle and bottom of the door. The multi-point connection helps in the preventing of bowing and hence leakage along the section that is open. However, because the swinging edge of the door is connected only by one point at the lock, bowing of the top and bottom of the door itself is more prevalent. Recently, multi-point locks have been utilized for doors. However, these locks have most often been incorporated into doors for increased security. For example, U.S. Pat. No. 4,548,342 discloses such a lock and is hereby incorporated by reference.

Still further, the prior art doors have been of a "sweep type" design. That is, the weatherstripping on the bottom of the door extended downward and generally came in contact with the threshold. Still further, no pressure equalization chambers were utilized to aid in the prevention of water seeping through the door. Such pressure equalization chambers are in existence for windows. However, the windows are generally outwardly swinging and also the designer of windows is not concerned with stepping up and over threshold as is the designer of doors.

The National Wood Window and Door Association is developing a standard for wood swinging patio doors. As part of the standard with respect to air infiltration, the Association requires that the unit shall be tested for air leakage in accordance with the latest revision of ASTM E-283 "Standard test method for air leakage through exterior windows, curtain, walls and doors." Air infiltration shall not exceed 0.34 cubic feet per minute, per square foot overall area when tested at a uniform static air pressure difference of 1.56 pounds per square feet. The water penetration resistance in test standard is that the unit shall be tested for water penetration resistance in accordance with ASTM E-547 "Standard test method for penetration of exterior windows, curtain walls and doors by cyclic air pressure differential." The unit shall be tested under a static pressure difference of 2.86 PSF. A minimum of three cycles of no less than 5 minutes each shall be used during the test. At the conclusion of the test, no water shall have passed beyond the interior face of the door unit and overflowed into the room or flowed into the wall area. The present invention is able to well surpass these standards and in fact air infiltration does not exceed 0.20 cubic feet per minute and the water penetration can be tested under a static air pressure difference of up to 6.24 PSF.

Further, with respect to structural claim testing, the present invention will take a 60 PSF positive/negative load using ASTM E-330 with no breakage or unit failure after loads are removed. Residual deflection is less than 0.4% of its span.

The present invention addresses the problems associated with prior art and provides for an improved door having increased air infiltration, water penetration and structural characteristics.

SUMMARY OF THE INVENTION

The present invention provides for an inwardly swinging door assembly for mounting into a building frame. The door assembly includes a door member having a top edge surface, bottom edge surface and first and second side edge surfaces. The assembly is provided with means for hingedly mounting the door member to the frame. The mounting means is proximate one of the first and second sides. A multi-point lock is mounted proximate the other of the first and second sides, whereby the frame is engaged by the lock at more than one point. Weatherstripping is cooperatively connected to the top edge surface, bottom edge surface and first and second side edge surfaces. A pressure equalization member is cooperatively connected to the frame for engaging the weatherstrip connected to the bottom edge surface.

In a preferred embodiment, the weatherstrips are all in a single plane and the weatherstrip is cooperatively connected at intersections of the surfaces, whereby a continuous weatherstrip is formed around the door member.

BRIEF DESCRIPTION OF THE DRAWINGS

FIG. 1 is a front plan view of the door assembly embodying the present invention.

FIG. 2*a* is a cross sectional area of the door assembly of FIG. 1, taken generally along the line FIG. 2*a*—2*a*.

FIG. 3*c* is a cross sectional view of the assembly of FIG. 1, taken generally along the lines 3*c*—3*c*.

FIG. 4 is an enlarged partial front plan view of a corner of the door member showing the joining of the weatherstrips.

DETAILED DESCRIPTION OF THE INVENTION

Referring to the figures, wherein like numerals represent like parts throughout the several views, there is generally illustrated at 10 an inwardly swinging door assembly.

The door assembly 10 is mounted in a frame 11. As shown in FIG. 1, the frame 11 is sized to receive not only the inwardly swinging door assembly 10 but also a stationary panel member, generally designated as 12. However, it is understood that the door assembly 10 may be mounted alone in a smaller frame or alternately, the frame may be larger to accommodate a plurality of stationary panel members 12. Still further, the position of the door assembly 10 may be varied within the frame 11. For example, where the frame 11 is sized sufficiently to accommodate two stationary panels and a door assembly 10, the door assembly 10 may be on either ends or in the center.

Figure 2C:
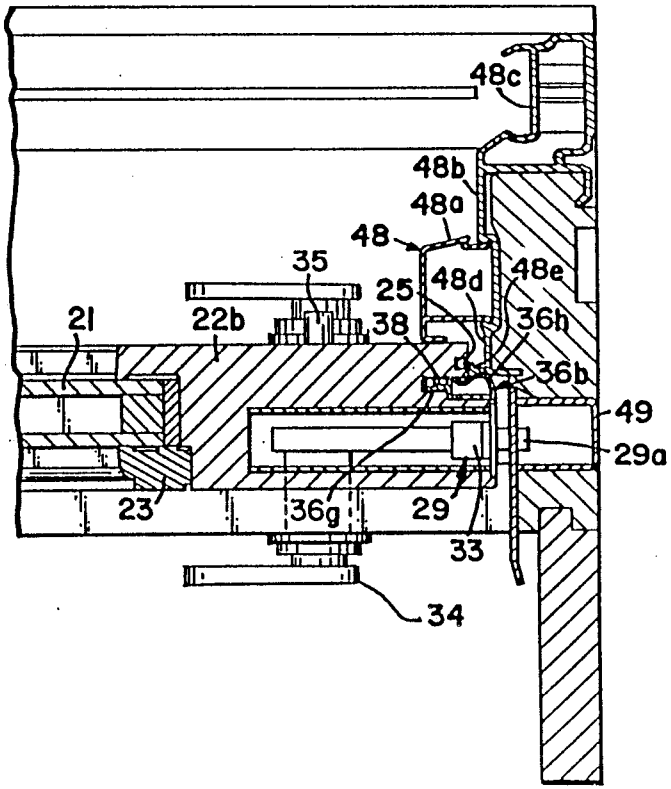
FIG. 2*c* is a cross sectional view of the assembly of FIG. 1, taken generally along the lines 2*c*—2*c*.
Figure 2B:
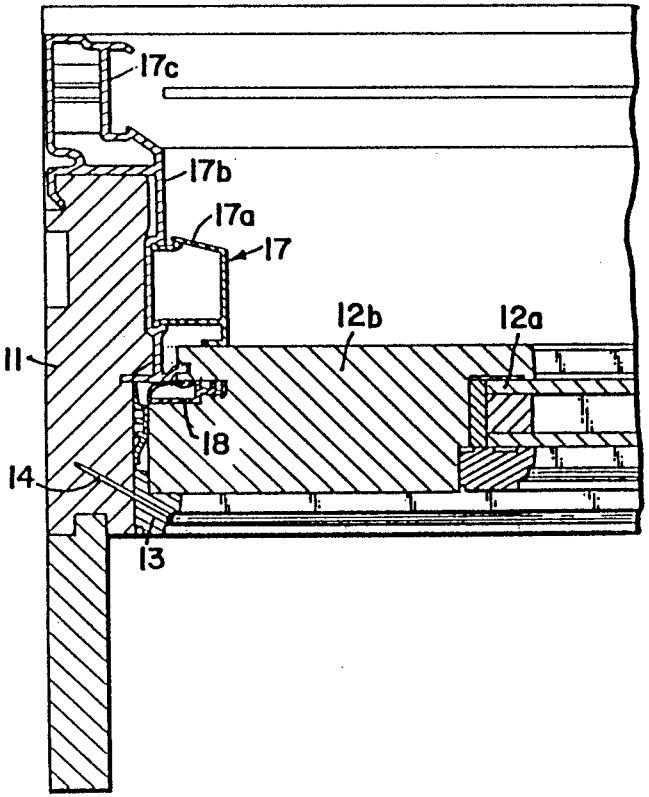
FIG. 2*b* is a cross sectional view of the assembly of FIG. 1, generally taken along the lines 2*b*—2*b*.

The stationary panel member 12, which is optional to the present invention, may be of any suitable type well known in the industry. The panel member 12 includes a double pane window assembly 12*a* which consists of an inner glass panel and an outer glass panel cooperatively connected together and mounted to a first side rail 12*b*, second side rail 12*c*, top rail 12*d* and bottom rail 12*e*. Moldings 13 are cooperatively connected and in turn fastened into the side rails 12*b* –*e* by means of nails 14. The molding cooperatively connected to the first side rail 12*b* is fastened to the portion of the frame 11, as shown in FIG. 2*b*. Similarly, the molding 13 cooperatively connected to the second side rail 12*c* is fastened by means of the nail 14 into the center support member 15. Similarly, molding adjacent the top and bottom rails 12*d* and 12*e* are fastened into the frame 11 by means of nails. The sill member 16, who cross section is best seen in FIG. 3*c*, extends between the two generally vertical members of the frame 11. The sill member 16 comprises a wooden portion 16*a* cooperatively connected to a metal portion 16*b* to form the sill 16. A threshold 16*c*is cooperatively connected to the top of the sill 16. The center support member 15 extends between the sill member 16 and the top horizontal member of the frame 11.

A first side jamb assembly 17 is cooperatively connected adjacent the first side rail 12*b* and extends between the frame 11 and sill 16. The first side jamb assembly 17 includes a first member 17*a* cooperatively connected to a second member 17*b* which forms the outer surface of the door opening. The second member 17*b* has a C-shaped section 17*c* which is adapted to receive an optional sliding screen door. Suitable weather stripping 18 is utilized between the first siderail 12*b* and the second member 17*b* of the first jamb assembly 17.

A first astragal assembly 19 is cooperatively connected to the center support member 15 and extends between the horizontal upper member of the frame 11 and the sill 16. The astragal assembly 19 includes a first member 19*a* which is cooperatively connected to the center support member 15 and has a generally planar bottom member which extends beyond the edges of the center support member 15. The ends of the planar bottom 19*b* are angled slightly upward. The first member also has two upwardly extending members 19*c* which have a top portion which extends generally outward. The second member 19*d* of the astragal assembly 19 has a configuration, shown in cross section in FIG. 2*a*, which is symmetrical on both sides of the center support member 15. The second member 19*d* engages the outwardly extending portion of the upwardly extending member 19*c*and also the stationary panel 12. Suitable weatherstripping 20 may be utilized to weatherproof the stationary panel 12. While the above-described construction of the stationary panel 12 is preferred, it is understood that any suitably constructed stationary panel 12 may be utilized.

The inwardly swinging door assembly 10 includes a door member 10*a* comprising a double pane assembly 21 mounted in a door panel 22. The door panel 22 has a first side rail 22*a*, second side rail 22*b*, top rail 22*c*, and bottom rail 22*d*, all cooperatively connected by means well known in the art to form the door panel. Suitable molding strips 23 may be utilized, where appropriate, around the double pane assembly 21. The construction of a door member 20, as described so far, is well known in the art.

The first side rail 22*a* has an edge surface 24. The second rail 22*b* has an edge surface 25. The top rail 22*c* has a top edge surface 26 and the bottom rail 22*d* has a bottom edge surface 27. As can be seen from the drawings, none of the edge surfaces 24 through 27 are planar. However, the designations for the edge surfaces generally designate the edges of the door member 20. However, as will be discussed more fully hereafter, the edge surfaces have cutouts to accommodate weatherstripping.

Three hinges 28 are cooperatively connected to the center support member 15 and the door member 20, proximate the edge surface 24 by means well known in the art. The door assembly 10 is hingedly mounted for swinging inward into a building. The door assembly 10 also includes a multi-point closing and locking latch assembly generally designated as 29. The locking assembly 29, as shown, includes three separate locking sub assemblies 30, 31 and 32. The locking sub assemblies are interconnected by means of an espagnolette bar 33. Rotation of the handle 34 will cause the locking assembly 29 to move between a latched and unlatched position. Rotation of the handle 34 causes all three sub assemblies to move between the latched and unlatched position. Further, by inserting a key and rotating the key into a lock 35, the locking assembly 29 may be locked by moving the bolt 29*a* into a strike plate 49. Locking assemblies 29 are well-known in the art, but to date have essentially been used for improved security. The multi-point locking assembly 29, with the three locking sub assemblies 30 through 32 provide for increased protection against a forced entry. However, such a locking assembly 29 also has significant advantages with respect to the weather integrity of the door. By latching the door at 30 and 32 as well as at 31, the door is secured along three points. This will prevent bowing of the door at the top and bottom as well as maintain the integrity of the weatherseal proximate the locking sub assemblies 30 through 32. Such a latch assembly is described in U.S. Pat. No. 4,548,432, and is hereby incorporated by reference. Further, such a locking assembly 29 is available for purchase from Fixfabriken in Gotenberg, Sweden. The oval lines shown in phantom 60, 61 and 62 in FIGS. 3*a*, 3*b* and 3*c*, respectively, show the locations of where the locking sub assemblies 30, 31 and 32 are positioned.

The weatherstripping, generally designated as 36, as will be described more fully hereafter, is cooperatively connected to the edge surfaces 24 through 27 on the door member 20. The weatherstripping 36 comprises four sections 36*a* through *d* and are carried entirely by the door member 20 and further are in one plane. Still further, the sections are cooperatively connected at the intersections to form one continuous weatherstrip around the door. The weatherstripping 36 can be seen in detail in FIGS. 2*a*, 2*c*, 3*a* and 3*c*. As seen in FIG. 2*a*, the first edge surface 24 has a notched area in which the weatherstrip 36*a* is fastened. Weatherstrip section 36*a*, as with the other sections, is a bulb type weatherstrip and has a first end 36*e* secured in a cavity 37 in door panel 22*a*. The section 36*a* has a protruding bulb section 36*f*, which is shown in a compressed configuration in FIG. 2*a*. The bulb section then continues and is again cooperatively connected into the cavity 37. The astragal assembly 19 has a weatherstrip engaging surface 19*e* that comes in contact with the bulb portion 36*f* of the section 36*a*.

As seen in FIG. 2*c*, the second edge surface 25 has a notched area in which the weatherstrip 36*b* is fastened. Weatherstrip section 36*b* is a bulb-type weatherstrip and has a first end 36*g* secured in a cavity 38 in door panel 22*b*. The section 36*b* has a protruding bulb section 36*h*, which is shown in a compressed configuration in FIG. 2*c*. The bulb section then continues and is again cooperatively connected into the cavity 38. A second side jamb assembly 48 is similar to the first side jamb assembly 17. The second side jamb assembly 48 is cooperatively connected to the frame 11 and is proximate the side rail 22*b* and extends between the frame 11 and sill 16. The second side jamb assembly 48 includes a first member 48*a* cooperatively connected to a second member 48*b* which forms the outer surface of the door opening. The second member 48*b* has a C-shaped section 48*c* which is adapted to receive an optional sliding screen door. The second side jamb assembly 48 also includes a flange 48*d* which in turn has a generally perpendicular cross section piece 48*e*. The cross section piece 48*e* forms a weatherstrip engaging surface which contacts the bulb portion 36*h* of the weatherstrip section 36*b*.

Figure 3A:
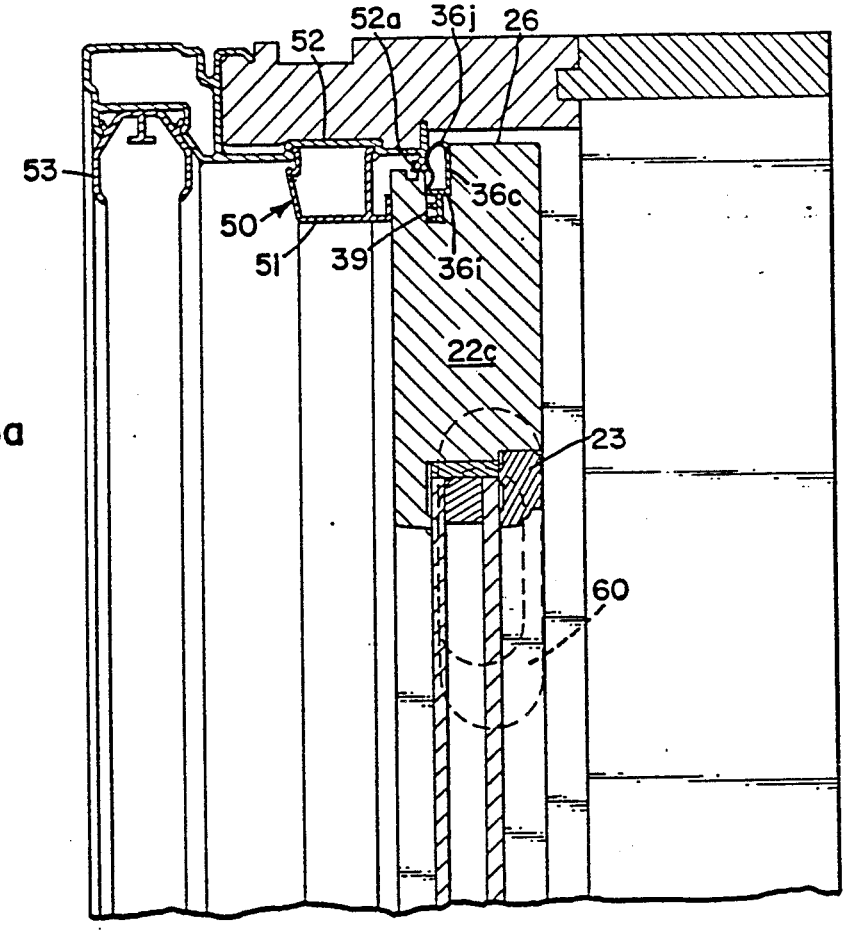
FIG. 3*a* is a cross sectional area of the door assembly of FIG. 1, taken generally along the line FIG. 3*a*—3*a*.
Figure 3B:
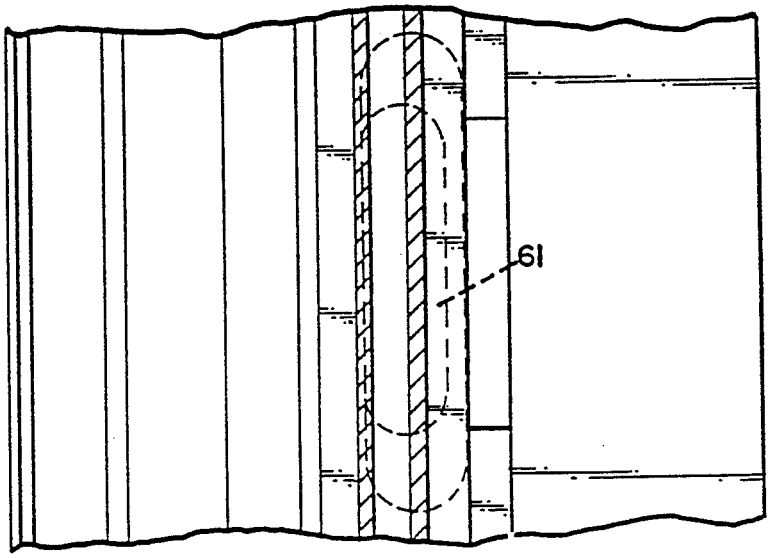
FIG. 3*b* is a cross sectional view of the assembly of FIG. 1, taken generally along the lines 3*b*—3*b*.

As seen in FIG. 3*a*, the edge surface 26 has a notched area in which the weatherstrip 36*c* is fastened. Weatherstrip section 36*c* is a bulb-type weatherstrip and has a first end 36*i* secured in a cavity 39 in the door panel 22*c*. The section 36*c* has a protruding bulb section 36*j*, which is shown in a compressed configuration in FIG. 3*a*. The bulb section then continues and is again cooperatively connected into the cavity 39. A top jamb assembly 50 as shown is FIG. 3*a* is cooperatively connected to the frame 11 and is proximate the top rail 22*c* and extends between the generally vertical upright members of the frame 11. The top jamb assembly 50 includes a first member 51 cooperatively connected to a second member 52. The second member 52 is adjacent and cooperatively connected to the frame 11, as previously discussed. The second member 52 includes a downwardly depending member 52*a* which forms a weatherstrip engaging surface which contacts the bulb portion 36*j* of weatherstrip section 36*i*. An optional assembly 53 may be attached to the top jamb assembly 50 when an optional screen is utilized.

As seen in FIG. 3*c*, the edge surface 27 has a notched area in which the weatherstrip 36*d* is fastened. Weatherstrip section 36*d* is a bulb-type weatherstrip and has a first end 36*k* secured in a cavity 40 in the door panel 22*d*. The section 36*d* has a protruding bulb section 361, which is shown in a compressed configuration in FIG. 3*c*. The bulb section then continues and is again cooperatively connected into the cavity 40.

The metal sill portion 16*b* has a downwardly sloping top surface 16*d* and two generally upright support members 16*e* and 16*f*. Further, the sill portion 16*b* extends past the support member 16*e* and has a further top surface 16*g* on which a guide 41 for a screen door may optionally be secured. At one end of the top surface 16*d*, an upwardly extending mounting member 16*h* is formed. A pressure equalization member, generally designated as 42, is cooperatively connected to the mounting member 16*h* of the middle sill 16*b*. The pressure equalization chamber extends the entire width between the frame 11 and the center support member 15. The pressure equalization member 42 has a first vertical member 43. The bottom end of the first vertical member 43 rests on the sill 16*b*. The height of the member 43 is greater than the pressure head that has to be withstood, approximately 1½ inches. A second generally vertical member 44 has a bottom portion which engages the mounting member 16*h*. A horizontal section 45 is cooperatively connected between the first and second vertical sections 43 and 44. The second vertical member 44 has a weatherstrip engaging surface 44*a* that comes in contact with the weatherstrip 36*d* and forms the weatherseal. The top portion of the pressure equalization member 42 forms a generally U-shaped trough. This U-shaped trough has a plurality of drain holes 46 spaced along its length. The pressure equalization member 42 also an inverted U-shaped area which has a plurality of drain holes 47 spaced along its length. A water shed member 55 has a first member 55*a* which extends across the width of the door member 10*a* and is cooperatively connected to the bottom rail 22*d* and an outwardly and downwardly extending section 55*b* which acts as a water shed for any water which cascades down the outer surface of the door 10*a*, to prevent access of the cascading water into the pressure equalization member 42.

All four of the weatherstrip engaging surfaces 19*e*, 44*a*, 52*a* and 48*e* of the door assembly 10 are in the same plane.

FIG. 4 is a front plan view of one corner section of the door 10*a*. The four weatherstrip segments are cooperatively connected at the intersections to form a continuous weatherstrip around the door member. Only one corner of the door 10*a* is shown in detail, but the other four sections are similarly constructed. FIG. 4 shows that the bulb sections 36*j* and 36*h* are cooperatively connected along a seam 70 to form one continuous weatherstrip.

Applicants have found that by utilizing the multi point lock in connection with weatherstripping cooperatively connected on all four sides to the door and a pressure equalization chamber that the door assembly is able to meet the qualifications as set forth in the description of the prior art in this application. The weatherstrip of the present invention is kept up off the ground and accordingly stays dryer than the weatherstrip of the prior art. The prior art often puts weatherstrip on the outside and the weatherstrip then becomes wet and air infiltration and water are then more easily able to pass through the weatherstrip barrier.

Other modifications of the invention will be apparent to those skilled in the art in light of the foregoing description. This description is intended to provide specific examples of individual embodiments or the use of elements having specific configurations and shapes as presented herein. All alternative modifications and variations of the present invention which follow in the spirit and broad scope of the appended claims are included.

We claim:

1. An inwardly swinging door assembly for mounting in a frame comprising:

(a) a door member having a top edge surface, bottom edge surface and first and second side edge surfaces;

(b) means for hingedly mounting said door member to the frame, said mounting means proximate one of said first and second side edge surfaces;

(c) a multi-point lock mounted proximate the other of said first and second side edge surfaces, whereby the frame is engaged by said lock at more than one point;

(d) a single point weatherstrips cooperatively connected to said top edge surface, bottom edge surface and first and second side edge surfaces, said weatherstrips having engaging surfaces, said engage surfaces in one plane, said single point weatherstrips comprising single strips of weatherstrip, said weatherstrips forming a continuous weatherstrip; and (e) pressure equalization member cooperatively connected to the frame for engaging said weatherstrip connected to said bottom edge surface, wherein air infiltration of said door assembly, as measured by ASTM E-283, does not exceed 0.34 cubic feet per minute per square foot of said door assembly will now allow water penetration, as measured by ASTM E-547, at 2.86 pounds per square foot.

2. The door assembly of claim 1, wherein said weatherstrip comprises bulb weatherstrips.

3. The door assembly of claim 2, wherein said lock engages the frame through said other of said first and second side edge surfaces.

4. The door assembly of claim 1, wherein said door assembly will withstand a 60 PSF positive/negative load when measured using ASTM E-330.

5. The door assembly of claim 1, wherein said air infiltration does not exceed 0.20 cubic feet per minute.

6. The door assembly of claim 5, wherein said door assembly will pass ASTM E-547 at 6.24 pounds per square foot.

7. The door assembly of claim 1, wherein said lock is a three point lock.

8. The door assembly of claim 1, wherein said weatherstrips are in one plane.

9. The door assembly of claim 1, wherein said weatherstrip is cooperatively connected at intersections of said surfaces, whereby a continuous weatherstrip is formed around said door member.

10. The door assembly of claim 1, wherein said pressure equalization member has first and second vertical sections and a horizontal sections cooperatively connected to said vertical sections.

11. The door assembly of claim 10, wherein said horizontal section has drain holes formed therein and said first vertical sections has drain holes formed therein.

12. The door assembly of claim 11, wherein said first and second vertical sections are spaced apart from said bottom edge surface.

13. The door assembly of claim 11, wherein said bottom edge surface has an upper face and lower face cooperatively connected by a generally upright vertical face and said weatherstripping is cooperatively connected to said vertical face, said bottom surface, and said weatherstripping connected to said vertical face engages said first vertical section.

14. The door assembly of claim 1, further comprising a water shed member cooperatively connected to the door member to prevent water which may cascade down the door member from entering the pressure equalization member.

15. An inwardly swinging door assembly for mounting in a frame comprising:

(a) a door member having a top edge surface, bottom edge surface and first and second side edge surfaces;

(b) means for hingedly mounting said door member to the frame, said mounting means proximate one of said first and second side edge surfaces;

(c) a three point lock mounted proximate the other of said first and second side edge surfaces, whereby the frame is engaged by said lock at more than one point;

(d) single point weatherstrips cooperatively connected to said top edge surface, bottom edge surface and first and second side edge surfaces said weatherstrips are cooperatively connected at intersections of said surfaces, whereby a continuous weatherstrip, in one plane, is formed around said door member said single point weatherstrips comprising single strips of weatherstrip;

(e) pressure equalization member cooperatively connected to the frame for engaging said weatherstrip connected to said bottom edge surface, said pressure equalization member has first and second vertical sections and a horizontal section cooperatively connected to said vertical sections, said horizontal sections has drain holes formed therein and said first vertical section has drain holes formed therein; and (f) assemblies cooperatively connected to the frame, proximate said top, first and second edge surfaces when said door member is in a closed position, said assemblies having a weatherstrip engaging surface, said engaging surfaces being in one plane, wherein air infiltration of said door assembly, as measured by ASTM E-283, does not exceed 0.34 cubic feet per minute per square foot of said door assembly will now allow water penetration, as measured by ASTM E-547, at 2.86 pounds per square foot.

* * * * *

UNITED STATES PATENT AND TRADEMARK OFFICE

CERTIFICATE OF CORRECTION

PATENT NO. : 4,999,950

DATED : March 19, 1991

INVENTOR(S) : Scott R. Beske, Stillwater, Minnesota
Harold H. Evans, Hudson, Wisconsin It is certified that error appears in the above-identified patent and that said Letters Patent is hereby corrected as shown below:

Col. 3, line 26, delete "16Cis" should read --16c is--

Col. 3, line 58, delete "19cand" should read --19c and--

Col. 7, line 42, delete "sections" should read --section--.

Col. 7, line 46, delete "sections" should read --section--.

Claim 1 (d), col. 7, line 3, delete "a" after the letter "(d)."

Claim 15, col. 8, line 38, delete "sections" should read --section--

Col. 7, line 17, delete "now" should read --not--.

Signed and Sealed this

Fifth Day of July, 1994

Bruce Lehman

*Attest:*

BRUCE LEHMAN

*Attesting Officer*

*Commissioner of Patents and Trademarks*